US006627851B2

(12) United States Patent
Sangwan et al.

(10) Patent No.: US 6,627,851 B2
(45) Date of Patent: Sep. 30, 2003

(54) POWER CONTROL METHOD FOR A MOTOR VEHICLE ELECTRIC WINDOW HEATER

(75) Inventors: Karma Vir Sangwan, East Amherst, NY (US); Thomas Martin Urbank, Lockport, NY (US); Charles Andrew Archibald, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 32 days.

(21) Appl. No.: 10/011,105

(22) Filed: Dec. 7, 2001

(65) Prior Publication Data

US 2003/0106883 A1 Jun. 12, 2003

(51) Int. Cl.[7] ..... H05B 1/02

(52) U.S. Cl. ..... 219/203; 219/497; 219/494; 340/602

(58) Field of Search ..... 219/203, 202, 219/205, 494, 497, 501, 505, 508; 340/602, 601; 307/117

(56) References Cited

U.S. PATENT DOCUMENTS 3,934,111 A * 1/1976 Roselli et al. ..... 219/203
4,260,876 A * 4/1981 Hochheiser ..... 219/203
5,496,989 A * 3/1996 Bradford et al. ..... 219/497
5,653,904 A * 8/1997 Adlparvar et al. ..... 219/203
6,049,069 A * 4/2000 Hochstein ..... 219/407
6,100,500 A 8/2000 Jefferson, Jr. et al. ..... 219/203

FOREIGN PATENT DOCUMENTS

DE 19540566 6/1996
EP 0718165 6/1996

* cited by examiner

*Primary Examiner*—Mark Paschall
(74) *Attorney, Agent, or Firm*—Patrick M. Griffin

(57) ABSTRACT

An improved method of electric window heater activation automatically and independently activates front and rear window heaters at a variable level based on the respective potential of fogging, within the ability of the vehicle electrical system to supply the requested current without discharging the storage battery. A defog controller develops front and rear fog factors indicative of the relative potential of fogging, and activates the respective electric heaters as required to drive the respective fog factor to zero. The fog factors are based on an estimate of the cabin air dewpoint temperature, the temperature of the respective window surfaces, and a temperature interval over which the fog factor signals only partial activation of the respective heater. The temperature interval is biased in a direction to provide preventative activation of the heaters at a relatively low level when the electrical power requirement is limited, and the activation level is limited as required to prevent battery discharging.

5 Claims, 2 Drawing Sheets

POWER CONTROL METHOD FOR A MOTOR VEHICLE ELECTRIC WINDOW HEATER

TECHNICAL FIELD

This invention relates to electric heating of motor vehicle windows to remove or prevent the formation of ice and fog, and more particularly to a method of regulating the electric power supplied to the heaters.

BACKGROUND OF THE INVENTION

Many motor vehicles are equipped with electrically powered heaters for preventing or quickly removing fog and ice from the rear window, and in some cases from the front window (windshield). Rear window heaters are generally manufactured by forming a long serpentine conductor pattern on the glass, whereas front window heaters are generally manufactured by depositing a very thin film of conductive material on the glass. In either case, electric current is supplied to the heater to initiate heating in response to activation of a driver-operated switch, and the current is maintained for a predetermined interval, after which the heater is turned off to conserve power. Under most conditions, the heating interval is adequate to remove ice or fog, but under more severe conditions, the driver may need to reactivate the heater to obtain sufficient heating.

Although most rear window heaters have relatively modest power requirements (300W to 400W), front window heaters typically have much higher power consumption (1000W) and pose a significant burden on an ordinary vehicle electrical system, particularly under engine idle conditions when the alternator output is relatively limited. In fact, the combined electrical load of the front and rear window heaters may exceed the alternator capacity and seriously discharge the storage battery.

The above-mentioned drawbacks can be alleviated to some degree by installing a moisture sensor on the front and/or rear windows, and automatically activating the respective heaters only when fog or ice is actually present. In this vein, the U.S. Pat. No. 5,653,904 to Adiparvar et al. discloses a system for automatically activating a rear window heater when moisture or dew is detected on the rear window, and for automatically activating the defrost mode of the vehicle heating and air conditioning system when moisture or dew is detected on the front window. However, the problem of excessive power consumption can still occur, and there is no provision for activating the heaters to take preventative action against fogging. Accordingly, what is needed is a control for automatically activating the window heaters at a controlled activation level that eliminates and/or prevents the formation of ice and fog without over-taxing the vehicle electrical system.

SUMMARY OF THE INVENTION

The present invention is directed to an improved method of electric window heater activation wherein front and rear window heaters are automatically and independently activated at a variable level based on the respective potential of fogging, within the ability of the vehicle electrical system to supply the requested current without discharging the storage battery. According to the invention, a defog controller develops front and rear fog factors indicative of the relative potential of fogging, and activates the respective electric heaters as required to drive the respective fog factor to zero.

The fog factors are based on an estimate of the cabin air dewpoint temperature, the temperature of the respective window surfaces, and a temperature interval over which the fog factor signals only partial activation of the respective heater. The temperature interval is biased in a direction to provide preventative activation of the heaters at a relatively low level when the electrical power requirement is limited, and the activation level is limited as required to prevent battery discharging.

DESCRIPTION OF THE PREFERRED EMBODIMENT

Figure 1:
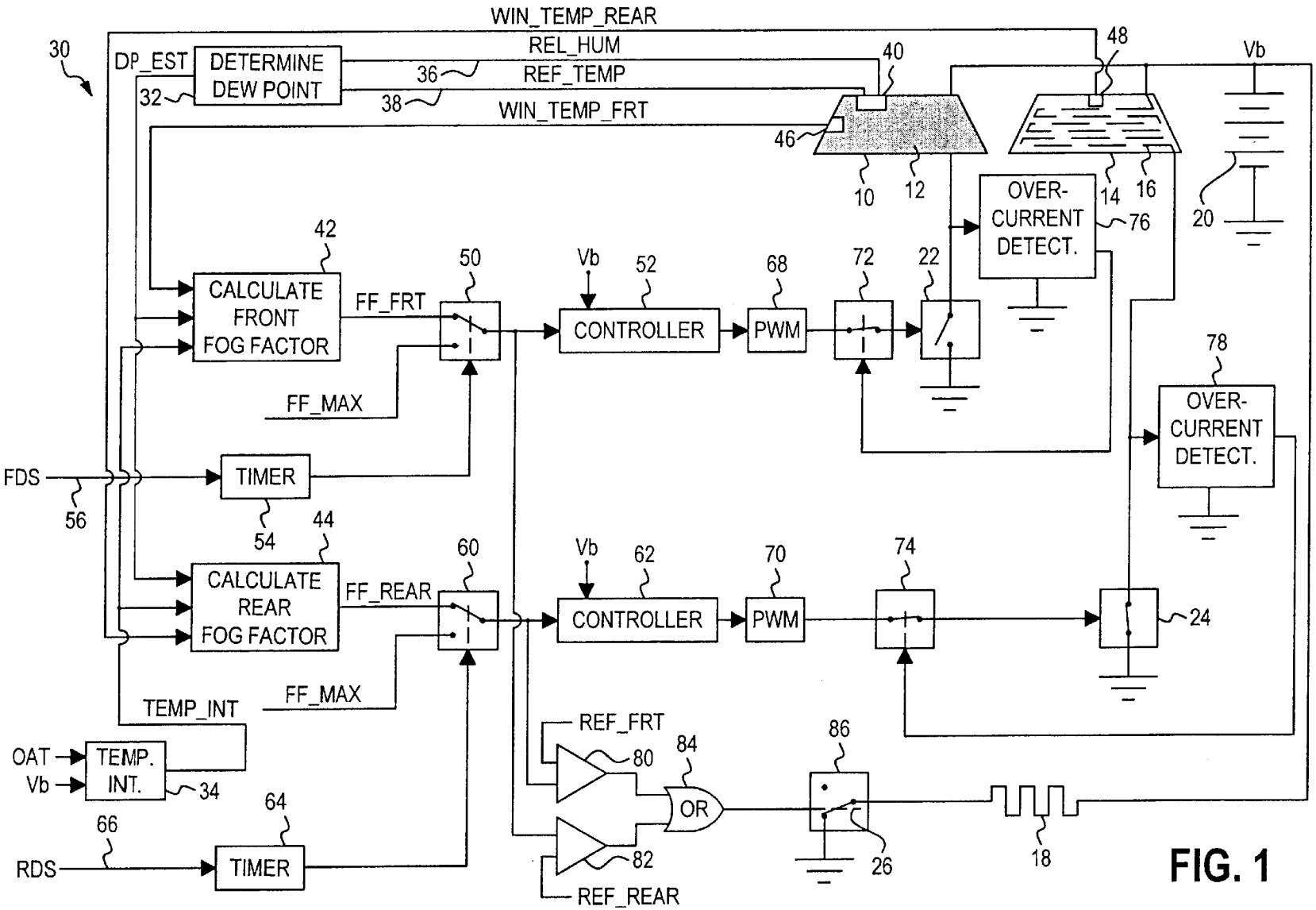
FIG. 1 is a block diagram of a motor vehicle electric window heating system controlled according to this invention.

Referring to FIG. 1, the method of this invention is described in the context of a motor vehicle having electrically activated heating mechanisms for its front, rear and side windows. The heater for the front window 10 is defined by a thin coating of conductive material 12, the heater for the rear window 14 is defined by a serpentine conductor pattern 16, and the heater for the side windows is defined by a resistive heating element 18. Whereas the front and rear window heaters 12, 16 are applied directly to the respective windows 10, 14, the side window heater 18 is disposed in a remote location of the vehicle, and heat developed by the heater 18 is delivered to the side windows of the vehicle by suitable ductwork and an electric blower motor, for example. The ungrounded terminal of the vehicle storage battery 20 is coupled to one terminal of each heater 12, 16, 18, while the other terminal of each heater is selectively coupled to ground by a respective switch mechanism 22, 24, 26 to enable selective activation of one or more of the heaters 12, 16, 18. As described below, the front and rear heaters 12, 16 are independently activated based on a detected potential for fogging of the respective front and rear windows 10, 14, while the side window heater 18 is activated when a specified fogging potential of the front or rear windows 10, 14 is detected. Although not shown in FIG. 1, the storage battery 20 typically forms part of a vehicle electrical system, including an engine driven generator or alternator for developing electrical power during engine operation for charging the battery 20 and powering various electrical loads of the vehicle, including the heaters 12, 16 and 18.

Figure 2:
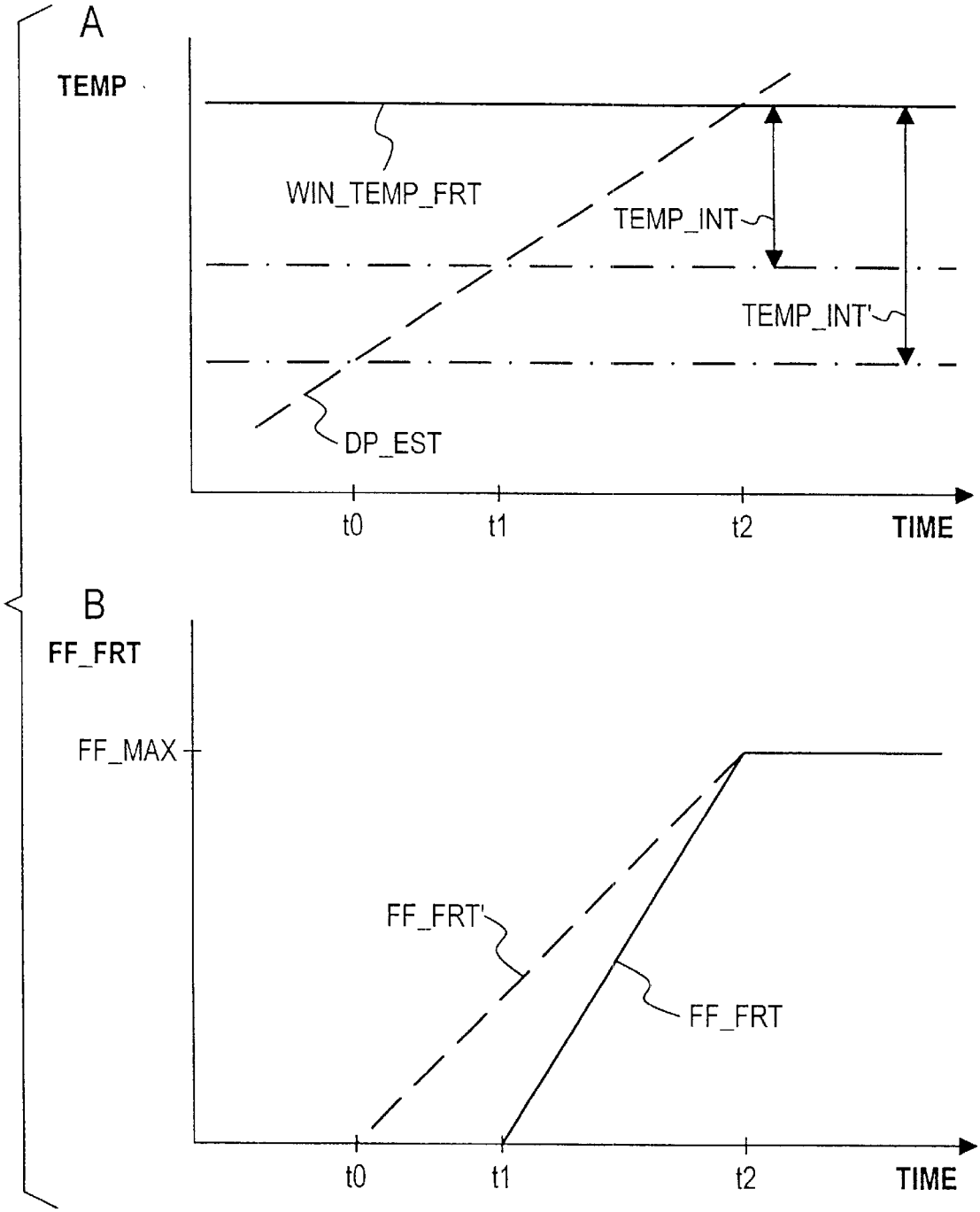
FIG. 2, Graphs A and B illustrate a relationship among dewpoint, windglass temperature and fog factor according to this invention. Graph A depicts the dewpoint and windglass temperature as a function of time, while Graph B depicts the fog factor as a function of time.

The reference numeral 30 generally designates a heater control system for determining front and rear fog factors FF_FRT, FF_REAR indicative of the potential for fogging on the front and rear windows 10, 14, and for automatically activating the switch mechanisms 22, 24, 26 as required to eliminate and prevent the formation of fogging on the respective windows within the ability of the vehicle electrical system to supply the required current without discharging the storage battery 20. The fog factors FF_FRT, FF_REAR are each based on a cabin dew point estimation DP_EST determined by the block 32, a measure of window surface temperature (WIN_TEMP_FRT, WIM_TEMP_REAR), and a temperature interval TEMP_INT determined by block 34. The block 32, which may be simply implemented as a 2-D look-up table, develops the dew point estimate DP_EST in response to relative humidity and reference temperature signals (REL_HUM, REF_TEMP) developed on lines 36 and 38 by suitable humidity and temperature sensors co-located in a single module 40 on an inside surface of front window 10. The reference temperature REF_TEMP is simply the air temperature at the point of relative humidity measurement. The front and rear fog factors FF_FRT, FF_REAR are calculated according to the relative values of DP EST and the respective window temperature WIN_TEMP_FRT and WIN_TEMP_REAR. Specifically, FF_FRT is set to a maximum value FF_MAX when WIN_TEMP_FRT is less than DP_EST, and to zero whenever WIN_TEMP_FRT exceeds DP_EST by at least TEMP_INT. Similarly, FF_REAR is set to FF_MAX when WIN_TEMP_REAR is less than DP_EST, and to zero whenever WIN_TEMP_REAR exceeds DP_EST by at least TEMP_INT. Finally, FF_FRT is determined according to:

$$FF_FRT=[1-(WIN_TEMP_FRT-DP_EST)/TEMP_INT]*FF_MAX \quad (1)$$

when WIN_TEMP_FRT is between DP_EST and (DP_ES+TEMP_INT), and FF_REAR is determined according to:

$$FF_REAR=[-(WIN_TEMP_REAR-DP_EST)/TEMP_INT]*FF_MAX \quad (2)$$

when WIN_TEMP_REAR is between DP_EST and (DP_ES+TEMP_INT). FIG. 2 graphically illustrates this relationship for the case of front fog factor FF_FRT; Graph A depicts WIN_TEMP_FRT, DP_EST and TEMP_INT, while Graph B depicts FF_FRT, all as a function of time. In the illustration, the window temperature WIN_TEMP_FRT remains steady, while the dew point DP_EST rises with time due to the breath of cabin occupants, for example. Prior to time t1, DP_EST is below WIN_TEMP_FRT by at least TEMP_INT, and FF_FRT has a value of zero. When DP_EST rises above (WIN_TEMP_FRT−TEMP_INT) beginning at time t1, FF_FRT is determined a according to equation (1) above, and has a value between zero and FF_MAX; and once DP_EST reaches WIN_TEMP_FRT at time t2, FF_FRT is maintained at the maximum value FF_MAX. Of course, the same relationship is true for FF_REAR and WIN_TEMP_REAR.

The temperature interval TEMP_INT developed by block 34 has a nominal value such as designated by the label TEMP_INT in Graph A of FIG. 2, but is enlarged when the outside air temperature OAT is low or when the terminal voltage Vb of battery 20 indicates that the power budget for operating the window heaters 12, 14, 18 is low. As illustrated in FIG. 2, enlarging TEMP_INT provides anticipatory heating of the windows 10, 14. Referring to FIG. 2, it is seen that a higher temperature interval value designated in Graph A as TEMP_INT' causes an earlier increase of FF_FRT, as designated by the trace FF_FRT' in Graph B. In the case of low outside air temperature, the earlier activation of the respective heater(s) 12, 16, 18 produces a small amount of heating before it is actually required to prevent fogging in situations where the relative humidity (and therefore, the dewpoint temperature) in the vehicle rises due to occupant breath level or damp clothing, for example. In the case of low power budget, the earlier activation of the respective heater(s) 12, 16, 18 prevents fogging with low electrical power consumption, and lessens the likelihood that high power will be required to prevent fogging.

Referring again to FIG. 1, the block 42 computes the front fog factor FF_FRT, and the block 44 computes the rear fog factor FF_REAR. The front window temperature signal WIN_TEMP_FRT for computing FF_FRT is obtained from a temperature sensor 46 on front window 10, and the rear window temperature signal WIN_TEMP_REAR for computing FF_REAR is obtained from a temperature sensor 48 on rear window 14. The selector switch 50 is coupled to block 42, and applies FF_FRT as an input to controller 52 unless the timer 54 has been activated by the front defog switch (FDS) input on line 56. Once activated by the FDS input, the timer 54 causes the selector switch 50 to apply the maximum fog factor FF_MAX to controller 52 for a predetermined interval such as two minutes. Similarly, the selector switch 60 is coupled to block 44, and applies FF_REAR as an input to controller 62 unless the timer 64 has been activated by the rear defog switch (RDS) input on line 66. Once activated by the RDS input, the timer 64 causes the selector switch 60 to apply the maximum fog factor FF_MAX to controller 62 for a predetermined interval such as two minutes. In this way, the driver of the vehicle can request and obtain full activation of the front and/or rear heaters 12, 16 for a predetermined interval, as will become apparent in view of the following description.

The controllers 52 and 62 are responsive to the outputs of selector switches 50 and 60, respectively, and develop activation signals for the front and rear heaters 12, 16 for driving the respective fog factor input to zero. In a preferred embodiment, for example, each of the controllers 52 and 62 may be a closed-loop controller (such as a PID controller) that computes an error signal based on the magnitude of the respective fog factor input, and that develops an output signal based on the error signal so as to drive the error signal to zero. Alternatively, the controllers 52, 62 may carry out a fuzzy logic or other control rule. Optionally, the controllers 52, 62 may also be responsive to the battery voltage Vb for overriding the normal control if Vb indicates that the vehicle electrical system is no longer able to supply charging current to battery 20; in such case, the heater activation may be reduced to the point where battery charging occurs. The controller output signals are applied to PWM generators 68, 70 that supply corresponding on-off control signals to the respective switch mechanisms 22, 24, provided the respective circuit interrupters 72, 74 are closed as shown. The circuit interrupter 72 is activated to interrupt the input to switch mechanism 72 when block 76 detects an over-current or short-circuit condition of the front window heater 12, and the circuit interrupter 74 is activated to interrupt the input to switch mechanism 74 when block 78 detects an over-current or short-circuit condition of the rear window heater 16.

Finally, the comparators 80 and 82 compare the front and rear fog factors FF_FRT, FF_REAR to respective reference values REF_FRT, REF_REAR. If either reference value is exceeded, the OR-gate 84 activates the switch 86 to connect the side window heater 18 to ground as shown. In this way, side window heating occurs so long as significant fogging potential of the front or rear window 10, 14 is detected.

In summary, the control of this invention provides automatic and independent activation of electric window heaters at a variable level based on the respective potential of fogging, within the ability of the vehicle electrical system to supply the requested current without discharging the storage battery. Also, the driver of the vehicle may temporarily override the automatic control by manually activating the front and/or rear defog switch inputs to obtain maximum heating. Under automatic control, the electric power consumption is significantly reduced compared to a manual-only control because the heaters are only activated in relation to the potential for fogging. Additionally, the control provides anticipatory heating to prevent fogging when the power budget is low and/or the outside air temperature is very low. While described in reference to the illustrated embodiment, it is expected that various modifications in addition to those mentioned above will occur to those skilled in the art. For example, the control is applicable systems including a larger or smaller number of window heaters, or to electric, hybrid or fuel-cell vehicles, or even to non-vehicle installations, for example. Also, the cabin dew point may be estimated differently than shown; and the heater current may be controlled by a method other than PWM, such as a linear current control, for example. Thus, it will be understood that control methods incorporating these and other modifications may fall within the scope of this invention, which is defined by the appended claims.

What is claimed is:

1. A method of controlling activation of an electrical heater for a window, comprising the steps of:

determining a potential for fogging of the window based on an estimation of dew point in proximity to the window and a surface temperature of the window;

activating said electrical heater at an activation level determined in relation to said potential for fogging;

determining said potential for fogging such that said electrical heater is deactivated when the surface temperature of the window exceeds the estimated dew point by at least a predefined temperature difference; and increasing said predefined temperature difference under specified operating conditions to provide anticipatory heating of the window.

2. The method of claim 1, wherein the predefined temperature difference is increased when a measure of outside air temperature is lower than a predetermined temperature.

3. The method of claim 1, wherein the predefined temperature difference is increased when an electrical power budget for activation of said electric heater is lower than a predetermined value.

4. The method of claim 3, wherein a storage battery supplies electric current to the heater during activation of the heater, and the predefined temperature difference is increased when a terminal voltage of said storage battery is below a predetermined voltage.

5. The method of claim 1, including the step of:

setting said potential for fogging to a maximum value for a predetermined time interval in response to manual activation of a defog control switch.

* * * * *